US010124621B2

(12) United States Patent
Fuhse

(10) Patent No.: US 10,124,621 B2
(45) Date of Patent: Nov. 13, 2018

(54) OPTICALLY VARIABLE TRANSPARENT SECURITY ELEMENT

(71) Applicant: GIESECKE & DEVRIENT GMBH, München (DE)

(72) Inventor: Christian Fuhse, Otterfing (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/537,622

(22) PCT Filed: Dec. 1, 2015

(86) PCT No.: PCT/EP2015/002414

§ 371 (c)(1),
(2) Date: Jun. 19, 2017

(87) PCT Pub. No.: WO2016/096094

PCT Pub. Date: Jun. 23, 2016

(65) Prior Publication Data

US 2018/0037049 A1 Feb. 8, 2018

(30) Foreign Application Priority Data

Dec. 18, 2014 (DE) ..... 10 2014 019 088

(51) Int. Cl.

| | |
|---|---|
| ***B42D 25/00*** | (2014.01) |
| ***B42D 25/324*** | (2014.01) |
| ***B42D 25/351*** | (2014.01) |
| ***B42D 25/29*** | (2014.01) |
| ***B42D 25/364*** | (2014.01) |

(Continued)

(52) U.S. Cl.

CPC ..... *B42D 25/351* (2014.10); *B42D 25/00* (2014.10); *B42D 25/29* (2014.10); *B42D 25/324* (2014.10);

(Continued)

(58) Field of Classification Search

CPC ..... B42D 25/324

See application file for complete search history.

(56) References Cited

U.S. PATENT DOCUMENTS 4,025,673 A * 5/1977 Reinnagel ..... B42D 25/29 283/72
6,157,487 A * 12/2000 Staub ..... B42D 25/328 359/566

(Continued)

FOREIGN PATENT DOCUMENTS

AU 2014250641 A1 11/2014
DE 102009053925 A1 5/2011

(Continued)

OTHER PUBLICATIONS

International Search Report for corresponding International PCT Application No. PCT/EP2015/002414, dated Feb. 12, 2016.

*Primary Examiner* — Kyle R Grabowski
(74) *Attorney, Agent, or Firm* — Workman Nydegger

(57) ABSTRACT

An optically variable see-through security element for securing value objects with a flat, optically variable area pattern that in transmission shows a colored appearance with a viewing-angle-dependent, polychrome color change. The optically variable area pattern includes a multiplicity of facets acting in a substantially ray-optical manner, and the orientation is distinguished in each case by an inclination angle α relative to the plane of the area pattern, which inclination angle is between 0° and 45°, and by an azimuth angle θ in the plane of the area pattern. The facets are supplied with an interference layer with a viewing-angle-dependent color change in transmitted light. The optically variable area pattern includes at least two subregions having a multiplicity of identically oriented facets. The facets of the (Continued)

at least two subregions differ from each other with respect to the inclination angle relative to the plane and/or the azimuth angle in the plane.

20 Claims, 5 Drawing Sheets

(51) Int. Cl.
*B42D 25/373* (2014.01)
*B42D 25/425* (2014.01)

(52) U.S. Cl.
CPC ..... *B42D 25/364* (2014.10); *B42D 25/373* (2014.10); *B42D 25/425* (2014.10)

(56) References Cited

U.S. PATENT DOCUMENTS

| | | | | |
|---|---|---|---|---|
| 8,534,708 | B2 * | 9/2013 | Heim | B42D 25/351 283/72 |
| 8,964,296 | B2 | 2/2015 | Hoffmuller et al. | |
| 9,016,726 | B2 | 4/2015 | Rauch et al. | |
| 9,297,941 | B2 * | 3/2016 | Fuhse | B42D 25/00 |
| 2008/0258456 | A1 * | 10/2008 | Rahm | B42D 25/29 283/85 |
| 2008/0259456 | A1 * | 10/2008 | Schilling | B42D 25/324 359/571 |
| 2012/0228860 | A1 | 9/2012 | Rauch et al. | |
| 2012/0319395 | A1 * | 12/2012 | Fuhse | B42D 25/29 283/67 |
| 2013/0063826 | A1 | 3/2013 | Hoffmuller et al. | |
| 2013/0093172 | A1 * | 4/2013 | Fuhse | B42D 25/21 283/67 |
| 2014/0346766 | A1 * | 11/2014 | Walter | B42D 25/29 283/81 |
| 2016/0023495 | A1 * | 1/2016 | Fuhse | B42D 25/29 359/566 |

FOREIGN PATENT DOCUMENTS

| | | | |
|---|---|---|---|
| DE | 102010019766 | A1 | 11/2011 |
| DE | 102013002137 | A1 | 8/2014 |
| WO | 2012055506 | A1 | 5/2012 |

* cited by examiner

OPTICALLY VARIABLE TRANSPARENT SECURITY ELEMENT

BACKGROUND

The invention relates to an optically variable see-through security element for securing value objects, with a flat, optically variable area pattern which in transmission shows a colored appearance with a viewing-angle-dependent, polychrome color change.

Data carriers, such as value documents or identification documents, but also other value objects, such as branded articles, are frequently provided for securing purposes with security elements which permit a check of the authenticity of the data carrier and which at the same time serve as protection against unauthorized reproduction. Here, see-through security features, such as see-through windows in banknotes, are becoming increasingly attractive.

Conventional transparent or semitransparent security elements with a viewing-angle-dependent, polychrome color change in transmitted light have various disadvantages, however. Thus, it is known for example to produce diffraction colors in transmitted light with transparently or semitransparently coated hologram gratings or transmission gratings, wherein it can be achieved by suitable choice of the grating periods and the azimuth angles of the gratings that different representations with changing colors emerge at different viewing angles. The appearance of such grating images, however, strongly depends on the lighting conditions. When illuminated with a point light source, individual subregions can flash very brightly and disappear quickly again at certain angles, while in diffuse ambient light only a very weak or possibly even no diffraction effect may be visible. Also, the perceived color does not only depend on the viewing angle to the security element, but also on the direction to the light source, wherein in addition a corresponding security element must not be held directly in front of a light source for viewing the diffraction colors of the first order, but the security element must be held somewhat out of the direct connecting line. Further, upon tilting the security element all rainbow colors are run through, so that the color changes occurring are largely undefined and the observed color effects are frequently perceived as simply colorful by the untrained viewer. Finally, holographic techniques have become common also outside the security sector and therefore now offer only a limited protection against imitation.

In a different solution, colors are produced with thin film systems through interference in incident light and in transmitted light, which colors change in dependence on the viewing angle. Different colors are therein usually realized by a variation of the layer thicknesses, for example the thickness of a dielectric spacer layer in a three-layer structure of absorber/dielectric/absorber. The adjustment of a desired color by adjusting the layer thicknesses is technologically very elaborate, however. One possibility is the regional printing of one or a plurality of dielectric layers, however very high demands are placed on the uniformity of the printed layers and the lateral resolution is limited to the resolution attainable by the corresponding printing methods. Moreover, motif changes upon tilting can practically not be implemented with such thin film systems.

A further solution is to produce colors in incident light and in transmitted light with transparently or semitransparently coated subwavelength structures, which colors change upon tilting the structures. Such subwavelength structures are very challenging to produce and difficult to manufacture on the required industrial scale, however.

Proceeding therefrom, it is the object of the present invention to specify a see-through security element of the type mentioned at the outset that avoids the disadvantages of the state of the art. In particular, the see-through security element is to combine an appealing visual appearance with high falsification security, and ideally be manufacturable on the industrial scale required in the security sector.

SUMMARY

According to the invention, in a generic optically variable see-through security element it is provided that

- the optically variable area pattern includes a multiplicity of facets which substantially act in a ray-optical manner, and the orientation of which is distinguished in each case by an inclination angle $\alpha$ relative to the plane of the area pattern which lies between 0° and 45° and by an azimuth angle in the plane of the area pattern,
- the facets are supplied with an interference layer with a color change that is viewing-angle-dependent in transmitted light, and
- the optically variable area pattern includes at least two subregions, respectively having a multiplicity of identically oriented facets, wherein the facets of the at least two subregions differ from each other with respect to the inclination angle relative to the plane and/or the azimuth angle in the plane.

Since the inclination angle and azimuth angle in the above-mentioned subregions of the optically variable area pattern are equal in each case for all facets, the subregions each represent exactly the regions of identically oriented facets.

In an advantageous embodiment, the facets of a subregion do not only have the same orientation, but also the same shape and size. The area occupied by each subregion on the optically variable area pattern in advantageous embodiments is at least 50 times, preferably at least 100 times, particularly preferably at least 1000 times greater than the area occupied on average by one individual facet of said areal region. The subregions thus usually include a very large number of individual facets.

In an advantageous embodiment, the facets of the at least two subregions differ from each other with respect to the inclination angle relative to the plane by 5° or more, preferably by 10° or more, particularly preferably by 20° or more. Alternatively or additionally, the facets of the at least two subregions differ from each other with respect to the azimuth angle in the plane by 45° or more, preferably by 90° or more, in particular by 180°.

The facets of the area pattern are preferably formed by flat area pieces that are respectively distinguished by their shape, size and orientation. The orientation of a facet is specified by the inclination a relative to the plane of the area pattern and by an azimuth angle $\theta$ in the plane of the area pattern. The azimuth angle $\theta$ therein is the angle between the projection of the normal vector of the facet to the plane of the area pattern and a reference direction in the plane. Since the azimuth angle $\theta$ depends on the choice of the reference direction its absolute value is not important, but the difference of the azimuth angles of different subregions all the more, since it describes the different relative orientation of the facets in the associated subregions. In principle it is also possible, although presently not preferred, to provide curved facets. Also in the case of these curved facets, the orientation can be specified by a normal vector averaged over their area and thus by an averaged inclination angle α and an averaged azimuth angle θ.

The dimension of the facets is preferably so large that little or no diffraction effects occur, so that the facets act in a substantially ray-optical manner only. In particular, the facets advantageously have a smallest dimension of more than 2 μm, preferably of more than 5 μm, in particular of more than 10 μm. In particular for application in banknotes and other value documents, the facets preferably have a height below 100 μm, preferably below 50 μm, in particular of less than 10 μm. The facets can be arranged regularly, for example in the form of a one- or two-dimensional periodical grid, such as a sawtooth grating, or also aperiodically.

A further possibility to suppress unwanted diffraction effects is to mutually offset the facets aperiodically in their height above the area region. When the facets are offset aperiodically, there is no simple, regular connection between the heights of adjacent facets, so that a constructive interference of light reflected at adjacent facets and thus the emergence of a superimposed diffraction pattern can be prevented reliably. Details of such an aperiodic offsetting can be gathered from the publication WO 2012/055506 A1, the disclosure of which is incorporated in the present application in this respect.

As interference layer in principle all coatings come into question which show a viewing-angle-dependent color change in transmitted light. A first example of an advantageous interference layer is a thin film element with semi-transparent metal layers and a dielectric spacer layer, in particular with a structure of absorber/dielectric/absorber, wherein for example metals such as Ag, Au, Cr or Al can be used as absorber layers and $SiO_2$, $MgF_2$, or polymers can be used as dielectric layer. Also dielectric layer systems, in particular multilayer systems, can be considered as interference layer, in particular layer structures with at least one highly refractive layer, such as $TiO_2$ or ZnS, preferably combined with at least one lowly refractive layer, such as $SiO_2$ or $MgF_2$. The thin film element can also include semiconductive layers, such as Si, for example a thin film structure of the layer sequence $Si/SiO_2/Si$ can be employed. As dielectric spacer layers, also polymers can be used here for example instead of oxides. Finally, also liquid-crystalline layers, especially with color-changing cholesteric liquid crystals, can be used as interference layer.

The entire optically variable area pattern is advantageously supplied with the same interference layer which is applied simultaneously to all facets. The interference layer can be structured after application by subsequent process steps to produce interference-layer-free regions. The interference layer can also have a locally different thickness depending on the inclination of the facets, as explained in more detail below.

In one advantageous embodiment, the interference layer has a layer thickness which is not substantially dependent on the inclination angle of the coated facets. Such a substantially constant layer thickness can be achieved for example by undirected coating methods or results from a coating with cholesteric liquid crystals in the form of a constant spacing of the planes with the same refractive index.

In a further, particularly advantageous embodiment, the facets are supplied with an interference layer the layer thickness of which varies with the inclination angle α of the facets, in particular decreases with an increasing inclination angle α. The present inventors have surprisingly found that such an interference layer makes it possible to produce particularly strong color differences between facets of different inclination. Thereby, on the one hand a particularly wide range of colors for the color appearances is available, which even allows the production of true-color images, on the other hand strongly pronounced color changes upon tilting the area patterns can be realized in this fashion. Such a varying layer thickness of the interference layer can be achieved for example by directed coating processes, such as vacuum vapor deposition. In such methods, the inclination angle of the facets leads to an enlargement of the effective surface, so that on inclined facets less material is deposited per area unit and the resulting layer thickness is thus strongly dependent on the inclination angle of the facets.

The facets are advantageously embossed into an embossing lacquer layer having a first refractive index. Above the interference layer a lacquer layer with a second refractive index is applied, which differs from the first refractive index of the embossing lacquer layer by less than 0.3, particularly less than 0.1. Through this substantially equal refractive index of the two lacquer layers, incident light passes through the security element independently of the local inclination angle α of the facets substantially without direction deflection, and thus ensures a uniform brightness distribution in the plane of the area pattern.

In an advantageous embodiment, the at least two subregions are arranged in the form of a motif, wherein the optically variable area pattern shows the motif formed by the subregions in transmission with two or more different colors, at least in certain tilted positions of the security element. For this purpose the inclination angles α and the azimuth angles θ of the facets and the interference layer in the two subregions are advantageously mutually coordinated such that the subregions show the same colors in one certain tilted position and different colors in different tilted positions. Overall, the security element then shows a motif which, upon tilting, emerges from an area of homogeneous apparition or disappears into an area of homogeneous apparition.

Since the full color effect of the coated facets depends not only on their orientation, but also on the properties of the specifically chosen interference layer, both the inclination angles α of the facets, the azimuth angles θ of the facets and the interference layer must be mutually coordinated in the subregions such that the desired color effect is achieved.

In an advantageous further development, the optically variable area pattern includes at least three subregions which are arranged in the form of a background region and of two foreground regions and in which the inclination angles α and the azimuth angles θ of the facets and the interference layer are mutually coordinated such that the optically variable area pattern in transmission

- in a first tilted position shows a first motif, in which the first foreground region appears with one motif color and the second foreground region and the background region appear with a background color different from the motif color, and
- in a second tilted position shows a second motif, in which the second foreground region appears with the motif color and the first foreground region and the background region appear with the background color.

Advantageously, the optically variable area pattern in a further development includes at least four subregions which are arranged in the form of a background region, of two foreground regions and one overlap region, and in which the inclination angles α and the azimuth angles θ of the facets and the interference layer are mutually coordinated such that the optically variable area pattern in transmission

- in a first tilted position shows a first motif, in which the first foreground region and the overlap region appear with one motif color and the second foreground region and the background region appear with a background color different from the motif color, and in a second tilted position shows a second motif, in which the second foreground region and the overlap region appear with the motif color and the first foreground region and the background region appear with the background color.

In all configurations, the optically variable area pattern advantageously includes at least two subregions in which the facets have the same inclination angle $\alpha$, but azimuth angles $\theta$ which differ from each other by 180°. The inclination angles $\alpha$ are advantageously larger than 5°, particularly preferably larger than 10°, and for example amount to 15°, 20° or 25°. As explained in more detail below, in this fashion a tilt image can be realized with a motif tilting out from a homogeneous area or tilting into a homogeneous area.

When the optically variable area pattern includes at least four subregions, it is advantageously provided that the optically variable area pattern includes a first and second subregion in which the facets have the same inclination angle $\alpha_0$, but azimuth angles $\theta$ differing from each other by 180°, and further includes a third and fourth subregion in which the facets have different inclination angles $\alpha_1$ and $\alpha_2$ and in which the azimuth angle $\theta$ differs from the azimuth angle of the first and second subregion by 90° or 270°. The inclination angles $\alpha_0$ are advantageously larger than 5°, particularly preferably larger than 10°, and for example amount to 15°, 20° or 25°. As explained in more detail below, in this fashion a tilt image with two different motifs can be realized in a particularly easy way.

In principle, tilt images can be realized with two different, also overlapping motifs already with an optically variable area pattern with only three subregions. However, in the case of at least partially overlapping motifs this usually requires a nesting of the subregions assigned to the motifs in which, as described in more detail below, the area pattern is divided into narrow strips or small pixels.

In an advantageous further development, the optically variable area pattern includes at least three subregions in which the inclination angles $\alpha$ and the azimuth angles $\theta$ of the facets and the interference layer are mutually coordinated such that the subregions appear in a tilted position in transmission in red, green, or blue. Preferably, these colors are produced in the non-tilted security element, thus when viewed perpendicularly in transmission. In an advantageous further development, the optically variable area pattern can additionally have in the subregions a black mask placed in register with the inclined facets, said black mask serving to adjust the brightness in transmission of the facets in the respective subregions. The three subregions can, optionally together with the black mask placed in register, each represent the color separations of a true-color image advantageously. In this fashion, true-color images can be represented which appear realistic in transmission in the chosen tilted position.

The invention also includes a data carrier with a see-through security element of the type described, wherein the see-through security element is preferably arranged in or above a window region or a through opening of the data carrier. The data carrier can in particular be a value document, such as a banknote, in particular a paper banknote, a polymer banknote or a foil composite banknote, but also an identification card, such as a credit card, a bank card, a cash card, an authorization card, a national identity card or a passport personalization sheet.

The invention further includes a method for manufacturing an optically variable see-through security element in which a substrate is made available and the substrate is supplied with a flat, optically variable area pattern which in transmission shows a colored appearance with a viewing-angle-dependent, polychrome color change. According to the invention, the optically variable area pattern is produced with a multiplicity of facets which act in a substantially ray-optical manner, the orientation of which is distinguished in each case by an inclination angle $\alpha$ relative to the plane of the area pattern, which lies between 0° and 45°, and by an azimuth angle $\theta$ in the plane of the area pattern, the facets are supplied with an interference layer with a viewing-angle-dependent color change in transmitted light, and the optically variable area pattern is produced with at least two subregions, respectively having a multiplicity of identically oriented facets, wherein the facets of the at least two subregions differ from each other with respect to the inclination angle relative to the plane and/or with respect to the azimuth angle in the plane.

In an advantageous process variant, the facets are coated with the interference layer in a directed coating method, particularly in a vacuum vapor deposit method.

BRIEF DESCRIPTION OF THE DRAWINGS

Further exemplary embodiments as well as advantages of the invention will be explained hereinafter with reference to the figures, in the representation of which a rendition that is true to scale and to proportion has been dispensed with in order to increase the clearness.

There are shown.

DETAILED DESCRIPTION OF VARIOUS EMBODIMENTS

Figure 1:
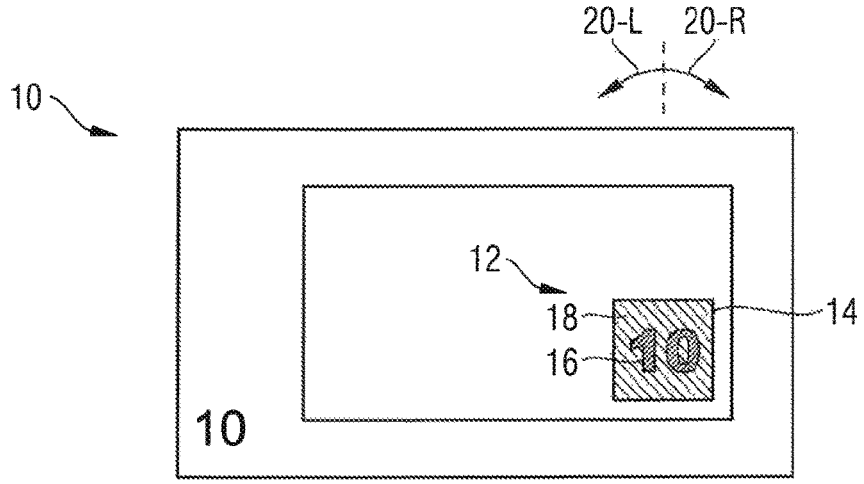
FIG. 1 a schematic representation of a bank note with an optically variable see-through security element according to the invention, FIG. 2 schematically the layer structure of the security element of FIG. 1 in cross section, FIG. 3 schematically a computed color spectrum of facets with a three-layer interference coating with a first, 25 nm thick Ag layer, a $SiO_2$ spacer layer of the thickness d and a second, likewise 25 nm thick Ag layer, applied as a function of the thickness of d and the angle $\phi$ of incidence of light on the interference coating, FIG. 4 (*a*) to (*b*) for explaining the occurring tilt effect, the security element of FIG. 2 with the interference coating of FIG. 3, in (a) in a non-tilted position and in (b) in a position tilted to the right by ß=20°, FIG. 5 (*a*) to (*d*) a security element according to a further embodiment example of the invention, in which different motifs are visible in different tilted positions, wherein (a) shows the division of the optically variable area pattern of the security element into three subregions in plan view, and (b) to (d) show the security element in cross section in different tilted positions, FIG. 6 a security element according to a further embodiment example of the invention, the optically variable area pattern of which is divided into four subregions, FIG. 7 schematically a computed color spectrum of coated facets at perpendicular incidence of light to the plane of the area pattern, wherein the interference coating is formed by a three-layer interference coating with a first, 25 nm thick Ag layer, a $SiO_2$ spacer layer of the nominal thickness do, and a second, likewise 25 nm thick Ag layer, and the layer thickness d of the spacer layer decreases with the inclination angle $\alpha$ in accordance with the relation $d=d_0 \cos \alpha$, wherein the color spectrum is applied as a function of the nominal thickness $d_0$ of the spacer layer and the inclination angle α of the facets, and FIG. 8 (*a*) to (*f*) in cross-section various intermediate stages of the manufacture of an optically variable area pattern for representing a true-color image with a black mask in exact register.

The invention will now be explained by the example of security elements for banknotes. FIG. 1 for this purpose shows a schematic representation of a banknote 10 with an optically variable see-through security element 12 arranged above a through opening 14 of the banknote 10. The security element 12 in transmission shows a colored appearance with a motif 16, 18 having a viewing-angle-dependent, polychrome color change.

In the embodiment example of FIG. 1, the security element 12 when viewed perpendicularly in transmission shows a homogeneous, monochrome yellow area in which the value number "10" of the foreground region 16 cannot be recognized due to lack of color difference to the background 18. However, when the security element 12 is tilted to the right or left (reference number 20-R, 20-L) and viewed at an oblique angle, the colors of the foreground 16 and of the background 18 change in different fashion, so that the value number "10" emerges clearly in the tilted position due to the color difference. For example, upon tilting to the right 20-R, the color in transmission of the background region 18 changes from yellow to green, while the color in transmission of the foreground region 16 changes from yellow to red. Upon tilting to the left 20-L reverse color changes result, that is the color in transmission of the background region 18 changes from yellow to red, while the color in transmission of the foreground region 16 changes from yellow to green. The security element 12 thus shows very different visual appearances in transmission from different viewing directions, which is unexpected for the viewer particularly in see-through elements and therefore has a particularly high attention and recognition value.

Figure 2:
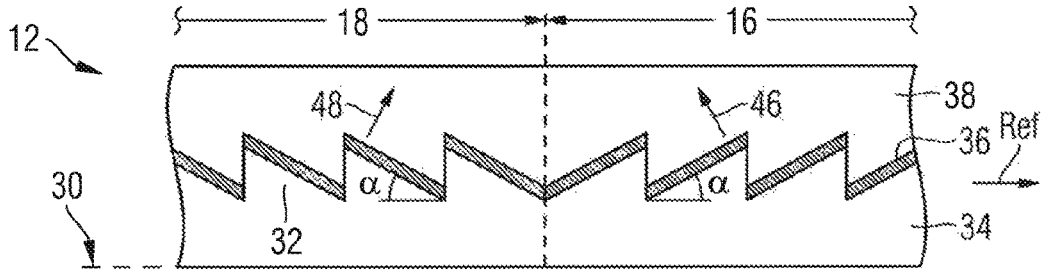

FIG. 2 schematically shows the layer structure of the security element 12 according to the invention in cross-section, wherein only the parts of the layer structure are represented which are required for the explanation of the functional principle.

The security element 12 has a flat, optically variable area pattern which includes a multiplicity of facets 32 which act in a substantially ray-optical manner. The facets 32 are formed by flat area pieces and are respectively distinguished by their shape, size and orientation. As already explained generally above, the orientation of a facet 32 is specified by the inclination α relative to the plane 30 of the area region and by an azimuth angle θ in the plane 30, wherein the azimuth angle θ is the angle between the projection of the normal vector 46, 48 of a facet 32 to the plane 30 and a reference direction Ref.

As shown in FIG. 2, the facets 32 in the subregions 16 and 18 have the same inclination angle α, for example, α=20°, the azimuth angles θ, however, differ by 180°, so that the facets 32 in the subregion 16 are tilted to the left, while the facets 32 in the subregion 18 are tilted to the right.

The facets 32 of the area pattern are embossed into a preferably transparent embossing lacquer 34 and have a square outline with a dimension of 20 μm×20 μm in the embodiment example. The facets 32 are further supplied with a nearly transparent or at least semitransparent interference coating 36, which produces a viewing-angle-dependent color impression in transmission.

The interference coating 36 can for example be formed of a three-layer thin film structure with two metallic semitransparent layers, for example of aluminum, silver, chromium, gold or copper, and an interposed dielectric spacer layer, for example of $SiO_2$, $MgF_2$ or a polymer. In the embodiments examples first described the thickness of the interference coating 36 is independent of the inclination angle α of the facets 32.

Above the interference coating 36 a further lacquer layer 38 is applied, which has substantially the same refractive index as the lacquer layer 34, which ensures that incident light passes through the layer sequence of the security element 12 independently of the local inclination angle α of the facets 32 substantially without direction deflection, thus producing a uniform brightness distribution in the plane of the area pattern.

The interference coating 36 of the facets produces a color impression in transmitted light which depends both on the direction of incidence of the light relative to the plane normal of the optically variable area pattern and the individual inclination angle of the facets 32, since both factors influence the angle of incidence of the light with reference to the normal of the interference coating 36.

Figure 3:
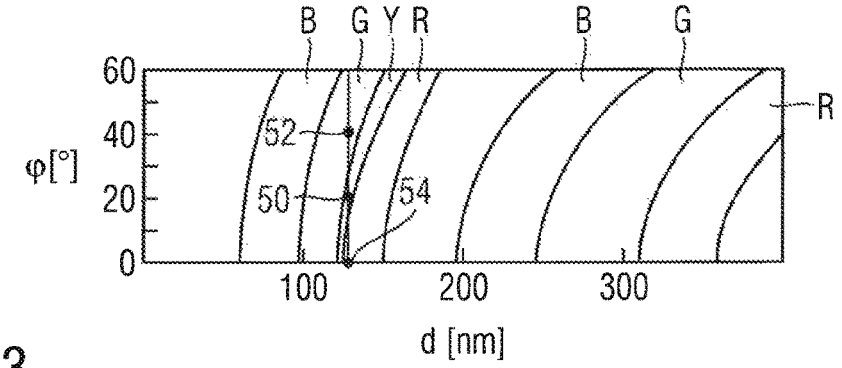

FIG. 3 schematically shows a computed color spectrum of facets 32 with a three-layer interference coating 36 with a first, 25 nm thick silver layer, a $SiO_2$ spacer layer of the thickness d and a second, 25 nm thick silver layer. The thickness of the spacer layer is applied on the abscissa here, while on the ordinate there is applied the angle ϕ of incidence of light on the interference coating, with reference to vertical incidence of light (ϕ=0°). As represented in FIG. 3, the color in transmission at perpendicular incidence of light with very thin spacer layers is initially outside the visible spectral range and then changes over blue (B), green (G) and yellow (Y) to red (R) with spacer layers with layer thicknesses in the range of approximately 130 nm. After a range without visible color in transmission, this sequence is repeated at higher layer thicknesses of 200 nm to approximately 350 nm.

Figure 4A:
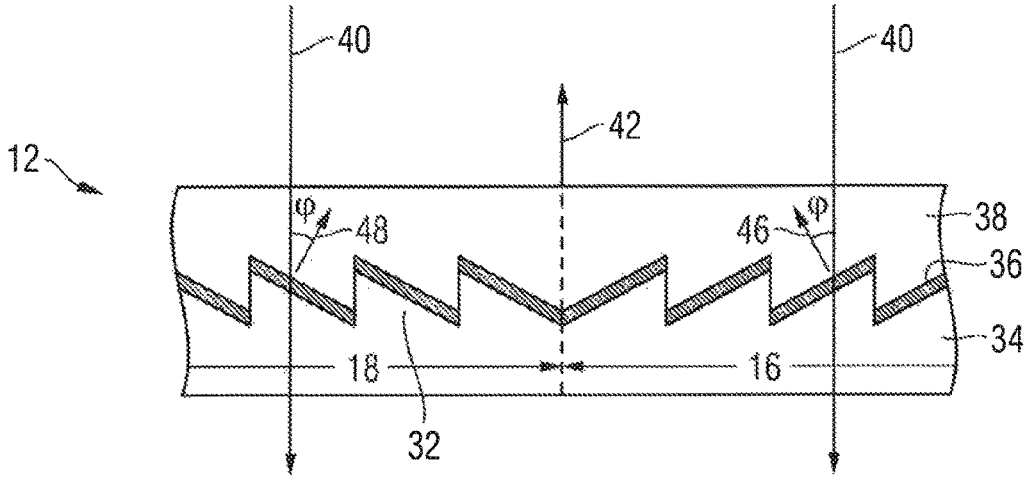
Figure 4B:
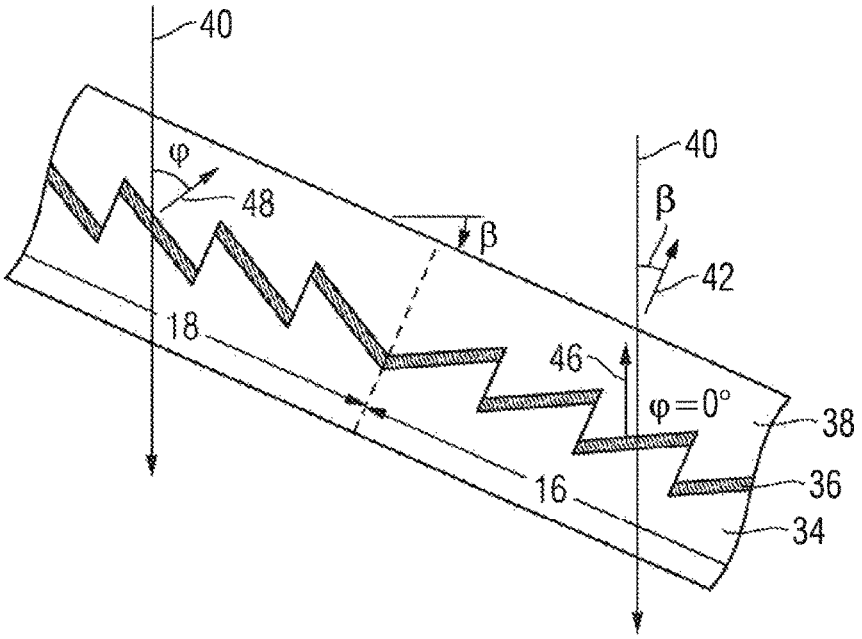
Figure 5A:
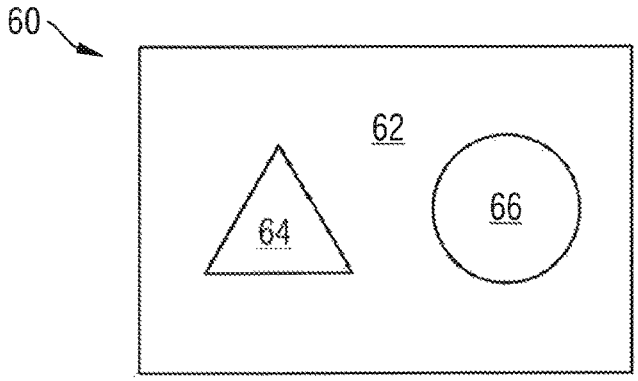
Figure 5B:
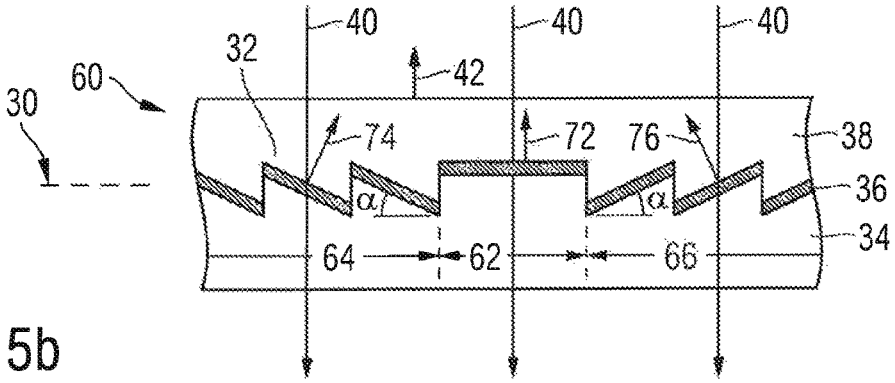
Figure 5C:
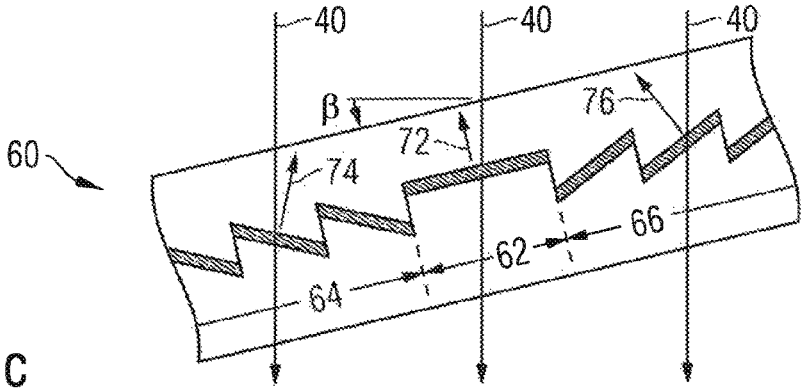
Figure 5D:
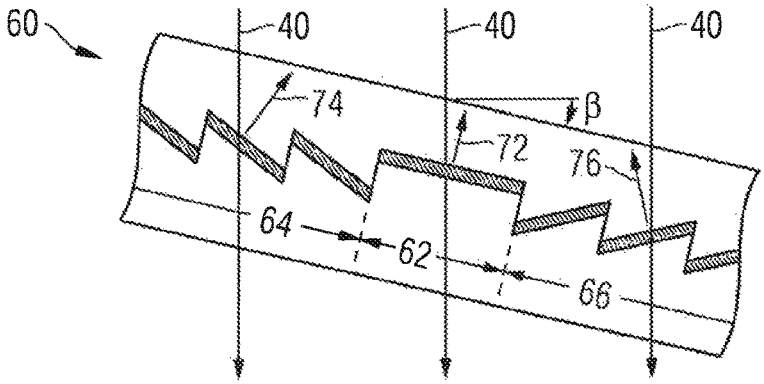

When in the embodiment of FIGS. 1 and 2 such an interference coating 36 with a $SiO_2$ spacer layer of the thickness d=130 nm is employed, in perpendicular incidence of light 40 there result the situations shown in the FIGS. 4(*a*) and (*b*) in dependence on the respective tilt state of the security element 12.

FIG. 4 (*a*) shows the security element 12 initially in a non-tilted position in which the light 40 incides parallel to the plane normal 42. Due to the inclination angle of α=20° of the facets 32 in the subregions 16, 18, the light 40 incides in both subregions alike at an angle of ϕ=20° with reference to the interference layer normal 46 or 48. As can be gathered from FIG. 3 at the point 50, the interference coating 36 produces a yellow color in transmission in both subregions 16, 18. The different azimuth angles of the facets 32 have no effect on the color in transmission here, since it does not lead to a change of the light incidence angle. Due to the lack of color contrast the subregions 16, 18 cannot be distinguished in transmission and the security element 12 appears as a monochrome, homogeneous area.

In FIG. 4 (*b*) the security element 12 is tilted by ß=20° to the right, so that the light 40 incides no longer parallel to the plane normal 42, but encloses an angle of ß=20° with it. Due to the different azimuth angle, the tilting of the security element 12 has different effects on the facets 32 in the subregions 16 and 18 respectively.

In the subregion 16, the angle between the incident light 40 and the interference layer normal is 46 is reduced by the tilting to the right by ß=20°, so that the light 40 now incides perpendicularly on the interference layer 36 there (ϕ=0°). As can be gathered from FIG. 3 at the point 54, the interference coating 36 therefore produces a red color in transmission in the subregion 16. In the subregion 18, on the other hand the angle between the incident light 40 and the interference layer normal 48 is increased by the tilting by ß=20°, so that the light 40 now incides there on the interference layer 36 at an angle of ϕ=40°. As can be gathered from FIG. 3 at the point 52, the interference coating 36 therefore produces a green color in transmission in the subregion 18.

Upon tilting by 20° to the left, the conditions are reversed correspondingly, so that then the light 40 incides perpendicularly on the interference layer 36 in the subregion 18, producing a red color in transmission there, while it incides at an angle of ϕ=40° on the interference layer 36 in the subregion 16, producing a green color in transmission.

The monochrome homogeneous color impression at perpendicular light incidence in FIG. 4 (*a*) is a consequence of the equality of the inclination angles α in the two subregions 16, 18 with a simultaneous azimuth angle difference of 180°. By choosing the inclination angles and/or azimuth angles differently, it can also be achieved that the homogeneous color impression emerges in other viewing directions. When, for example, at unchanged azimuth angles, in the subregion 18 there is chosen α=30° to the left as inclination angle and in the subregion 16 there is chosen α=0° as inclination angle, this results in a monochrome homogeneous color impression at a tilt angle of 15° to the left.

A security element 60 according to the invention can also show a tilt image in which different motifs are visible in different tilted positions, as explained now with reference to FIG. 5. FIG. 5 (*a*) first shows in plan view the division of the optically variable area pattern of the security element 60 into three subregions 62, 64, 66, which are arranged in the form of a background region 62, a first foreground region 64 (triangle) and a second foreground region 66 (circle).

FIG. 5 shows further in (b) to (d) the security element 60 in cross section in different tilted positions. The security element 60 is in principle structured like the security element 12 of FIG. 2, but includes three subregions with different orientation of the facets 32. In the foreground regions 64 and 66, the facets have the same inclination angle α relative to the plane 30, for example α=20°, but the azimuth angles θ of the foreground regions differ by 180°, so that the facets 32 in the subregion 64 are tilted to the right, whereas the facets 32 in the subregion 66 are tilted to the left. In the background region 62, the facets 32 are oriented parallel to the plane of the area element, thus have an inclination angle of α=0°.

The interference layer 36 in this embodiment example is chosen so that it produces an orange color in transmission at perpendicular light incidence (ϕ=0°), a yellow color in transmission at light incidence at ϕ=10°, a green color in transmission at light incidence at ϕ=20° and a blue color in transmission at light incidence at ϕ=30°.

In the non-tilted position of FIG. 5(*b*) the light 40 incides parallel to the plane normal 42, and therefore also incides perpendicularly on the facets 32 of the background region 62, whereas it encloses an angle of 20° in each case with both the facets 32 of the first foreground region 64 and the facets 32 of the second foreground region 66. The background region 62 therefore appears in orange in transmitted light, while the two foreground regions 64, 66 appear in green.

In the position of FIG. 5(*c*) the security element 60 is tilted by ß=10° to the left, so that the light 40 no longer incides parallel to the plane normal 42, but encloses an angle ß=10° with it. In the background region 62, the angle between the incident light 40 and the interference layer normal is 72 increased by ß=10° by the tilting, so that the light 40 now incides there at an angle of ϕ=10°, producing a yellow color in transmission as background color. In the first foreground region 64, the angle between the incident light 40 and the interference layer normal 74 in contrast is reduced by ß=10° by the tilting, so that the light 40 there now also incides at an angle of ϕ=10°, therefore producing a yellow color in transmission (the background color) like in the background region 62. In the second foreground region 66, the angle between the incident light 40 and the interference layer normal 76 is on the other hand increased by ß=10° by the tilting, so that the light 40 now incides there at an angle of ϕ=30° on the interference layer 36, therefore producing a blue color in transmission (the motif color). As a result, in this tilted position only the motif of the second foreground region 66 is visible, since the motif of the first foreground region 64 merges with the background region 62 of the same color.

Conversely, in the position of FIG. 5(*d*), the security element 60 is tilted to the right by ß=10°. In the background region 62, the angle between the incident light 40 and the interference layer normal 72 is increased again by ß=10° by this tilting, so that the light 40 incides there at angle of ϕ=10°, again producing a yellow color in transmission (the background color). The first and second foreground regions swap their roles now. In the first foreground region 64, the angle between the incident light 40 and the interference layer normal 74 is increased by ß=10° by the tilting, so that the light 40 now incides there at an angle of ϕ=30°, producing a blue color in transmission (the motif color). In the second foreground region 66, the angle between the incident light 40 and the interference layer normal 76 in the other hand is decreased by ß=10° by the tilting, so that the light 40 incides there at an angle of ϕ=10° on the interference layer 36, therefore producing a yellow color in transmission (the background color) like in the background region 62. As a result, only the motif of the first foreground region 64 is visible in this tilted position, since the motif of the second foreground region 66 merges with the background region 62 of the same color.

In the embodiment examples of FIGS. 2 and 5 a color change was presumed to occur upon tilting the security element to the right/left for the purpose of illustration. Depending on the azimuth angle of the facets 32, of course also different tilting directions, for example, an up/down tilting, can be used advantageously for the color change.

In the embodiment example of FIG. 5, the foreground regions 64, 66 are spatially separated from each other in the plane of the area pattern, thus do not overlap. When tilt motifs with overlaps are to be realized, this can be achieved for example by a nesting of the subregions assigned to the motifs. For this purpose the area pattern is divided into narrow strips or small pixels which alternately include the first foreground motif 64 and the background motif 62 on the one hand, and the second foreground motif 66 and the background motif 62 on the other hand. The dimensions of the small strips or pixels lie below 300 μm in particular, or even below 100 μm, so that the division of the area pattern cannot be recognized with the naked eye or is at least not noticeable.

However, the nesting of overlapping representations with three subregions having different facet orientations usually leads to the chromaticity and/or the contrast of the colors in transmission not reaching the maximally possible values, since partly only mixed colors can be produced due to the nesting, and mixed colors usually have a lower chromaticity than the original colors.

Figure 6:
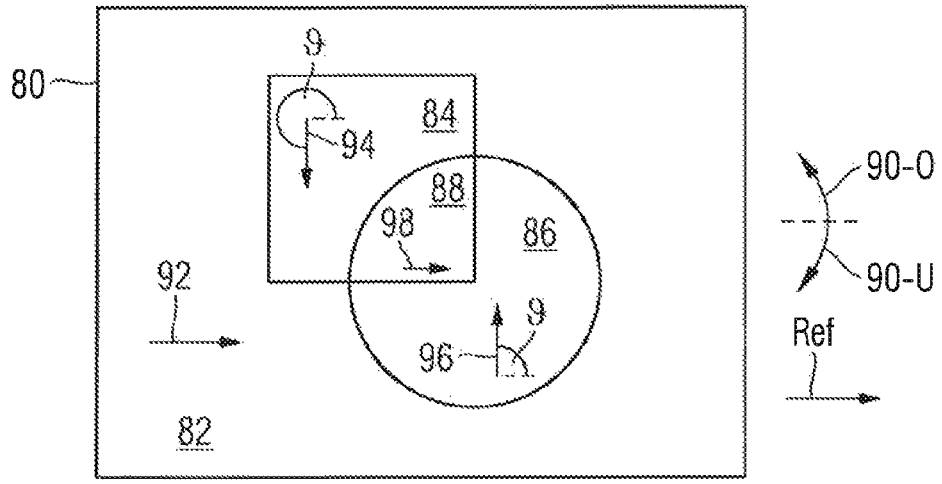

Very high-contrast and colorful images can be realized, however, by employing four subregions realize with different facet orientations, as shown in FIG. 6 schematically.

In the security element 80, the optically variable area pattern is divided into four subregions 82, 84, 86, 88, which are arranged in the form of a background region 82, a first foreground region 84 (square without circular segment 88), a second foreground region 86 (circular disk without circular segment 88) and an overlap region 88 (circular segment). The first foreground region 84 together with the circle segment 88 forms the complete square as the first motif to be represented, the second foreground region 86 together with the circular segment 88 forms the complete circular disk as the second motif to be represented. Although the two motifs to be represented overlap in the overlap region 88, their color in transmission is not to arise from color mixing.

The inclinations and azimuth angles of the facets in the four subregions for this purpose are chosen so that the security element 80 in a first tilted position in transmitted light shows the complete square (first foreground region 84 and circular segment 88 together) as the first motif to be represented with a uniform motif color, and shows the remaining area pattern (second foreground region 86 and background region 82) in a background color different from the motif color. In a second tilted position, the security element 80 in transmitted light shows the complete circle (second foreground region 86 and circular segment 88 together) as the second motif to be represented with the uniform motif color, whereas the remaining area pattern (first foreground region 84 and background region 82) appears with the background color.

To achieve this, the inclination and the azimuth angle of the facets in the background region 82 are thus chosen such that they produce the background color in each case, in both the first and in the second tilted position. The inclination and the azimuth angle of the facets in the first foreground region 84 are chosen so that they produce the motif color in the first tilted position and the background color in the second tilted position, while the facets in the second foreground region 86 are chosen so that they produce the background color in the first tilted position and the motif color in the second tilted position. In the overlap region 88 finally the inclination and azimuth angle of the facets are chosen so that they produce the motif color in each case, in both the first and the second tilted position. Altogether, four subregions with different orientations of the facets are thus required.

The required inclinations and azimuth angles in the various subregions can be ascertained for example by the following procedure, wherein it is presumed specifically that the first tilted position is caused by a tilting 90-O of the security element 80 by a certain angle from the horizontal upwards, while the second tilted position 80 is caused by a downward tilting 90-U of the security element by the same angle.

First, for the facets of the first and second foreground region 84, 86, the azimuth angle in the tilting direction 90-O, 90-U is determined, thus at $\theta=270°$ or $\theta=90°$ with reference to the reference direction Ref shown in the figure. As inclination angle $\alpha$ that angle is determined for both foreground regions which produces the desired motif color in the first and second tilted position upon an upward or downward inclination of the mirrors. This corresponds substantially to the procedure already described in connection with FIG. 2. For the purpose of illustration, in FIG. 6 also the projections of the normal vectors of the facets to the plane of the area pattern are drawn in the various subregions. For example, the facets in the first foreground region 84 have an inclination angle $\alpha=25°$ and an azimuth angle of $\theta=270°$ with reference to the reference direction Ref, as shown by the projected normal vector 94 (the azimuth angle is measured counterclockwise from the reference direction as usual). Accordingly, the facets in the second foreground region 86 also have an inclination angle $\alpha=25°$, but an azimuth angle of $\theta=90°$ with reference to the reference direction Ref, as shown by the projected normal vector 96.

Similar to FIG. 2, the facets in the subregions 84, 86 have the same inclination angle $\alpha$, whereas the azimuth angles $\theta$ differ by 180°. Due to of the symmetry of the arrangement it is thus ensured that the first foreground region 84 in the first tilted position shows the same color in transmission (motif color) as the second foreground region 86 in the second tilted position. The first foreground region 84 shows the background color in the second tilted position, like the second foreground region 86 does in the first tilted position.

Further, it was ascertained in a series of experiments at which inclination angles the facets coated with the chosen interference coating show the motif color or the background color in the first tilted position at an azimuth angle of 0° or 180°. These inclination angles generally depend on the type of interference coating, the dependence of the interference layer thickness on the inclination angle of the facets and the refractive indices of the embedded lacquer layers, but can be readily ascertained by a simple series of experiments. For example, the result is that the facets show the motif color in the first tilted position show at an azimuth angle of 0° and an inclination angle $\alpha_M$ and the background color at an inclination angle $\alpha_H$. Due to the symmetry of the arrangement it is then ensured that the facets show these colors also in the second tilted position, since said position is reached by tilting the security element by the same the same angular amount as the first tilted position.

The facets in the overlap region 88 are then formed with an inclination angle $\alpha=\alpha_M$ and an azimuth angle of $\theta=0°$ or $\theta=180°$, while the facets in the background region 82 are formed with a inclination angle $\alpha=\alpha_H$ and an azimuth angle of $\theta=0°$ or $\theta=180°$. The associated projected normal vectors 98 and 92 are drawn for $\theta=0°$ in FIG. 6. Due to the choice of orientation of the facets in the different subregions 82, 84, 86, 88 then exactly the above-described visual appearances are realized in the two tilted positions.

In the embodiments described so far, the thickness of the interference coating was independent of the inclination angle of the facets. Particularly strong color differences can be produced, however, when a coating method is chosen for applying the interference coating in which the achieved layer thickness depends on the inclination of the facets. This can be achieved by subjecting the facets to directed vacuum vapor deposition, for example, wherein there results a layer thickness by vertical vapor deposition that is substantially proportional to the cosine of the inclination angle $\alpha$, i.e.

$$d=d_0 \cos \alpha$$

with the nominal film thickness do which is obtained in non-inclined facets. As the inventors have surprisingly found, the color differences between differently inclined facets shown in FIG. 3 can be significantly enhanced by the layer thickness decreasing along with increasing inclination.

Figure 7:
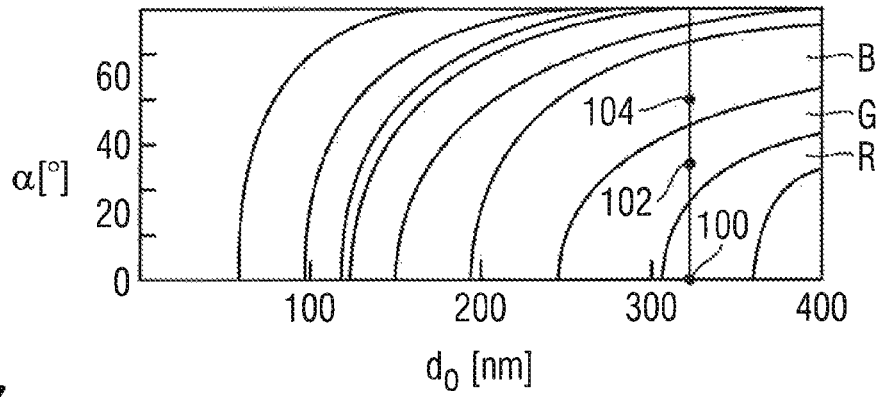
Figure 8A:
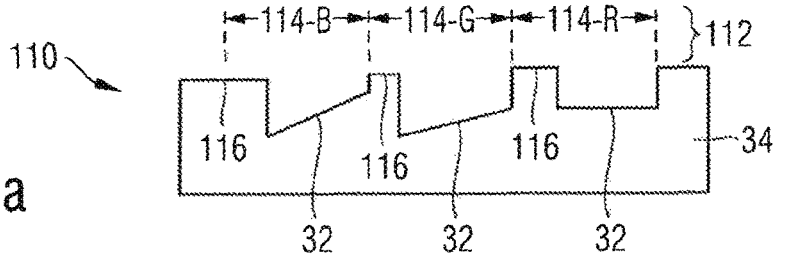
Figure 8B:
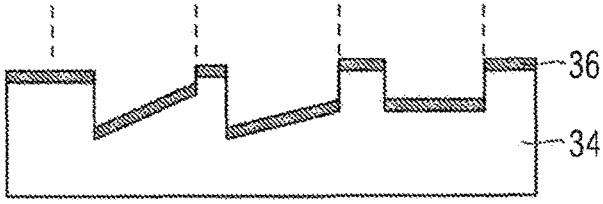
Figure 8C:
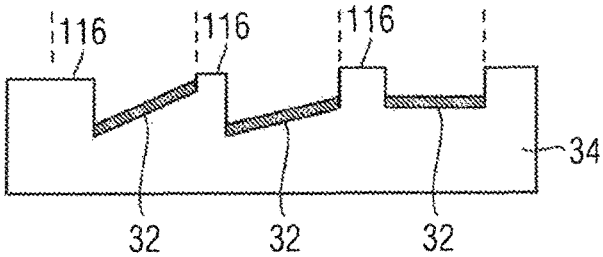
Figure 8D:
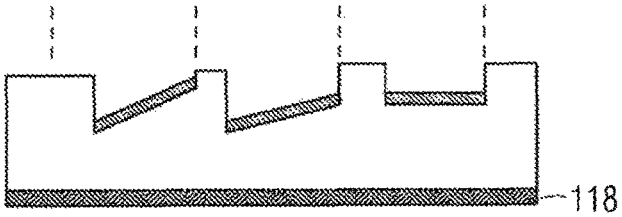
Figure 8E:
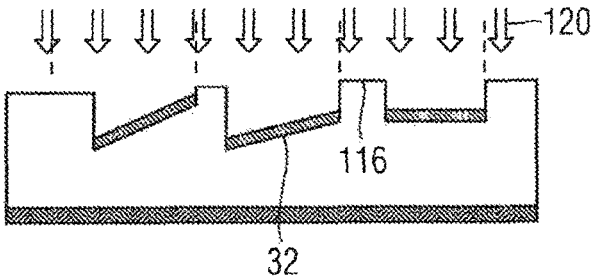
Figure 8F:
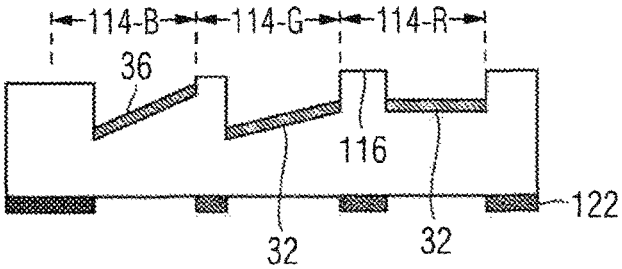

FIG. 7 in this regard shows schematically a computed color spectrum of coated facets at perpendicular light incidence on the plane of the area pattern, wherein the interference coating is formed by a three-layer interference coating with a first, 25 nm thick silver layer, a $SiO_2$ spacer layer of the nominal thickness do and a second, likewise 25 nm thick silver layer. It is assumed here that the real layer thickness d of the spacer layer in a facet with the inclination angle $\alpha$ decreases along with the inclination angle in accordance with the relationship $d=d_0 \cos \alpha$. The nominal thickness do is applied on the abscissa, while the inclination angle $\alpha$ of the facets is applied on the ordinate.

As shown by a comparison of FIGS. 3 and 7, substantially greater differences in color are achieved by the inclination-dependent layer thickness. Since facets of different inclination can be produced simply by embossing in an embossing lacquer layer 34, subregions of strongly different color can be arranged with high accuracy of a few micrometers to each other.

The embodiment examples described above can be realized not only with an interference coating of constant thickness, but advantageously also with an interference coating of inclination-dependent thickness, whereby it is possible to produce tilt images with particularly strong color contrasts, for example.

It is particularly noteworthy and surprising in this context that there are certain layer thicknesses in some interference layer systems in which the primary colors red, green and blue can be produced as colors in transmission with one and the same interference coating depending on the inclination angle of the facets. In the layer system shown in FIG. 7, for example, the color in transmission red (point 100) is produced at a nominal thickness of the spacer layer of $d_0=330$ nm at an inclination angle of $\alpha=0°$, the color in transmission green (point 102) is produced at an inclination angle of $\alpha=25°$ and the color in transmission blue (point 104) is produced at an inclination angle of $\alpha=40°$.

In this fashion, true-color images can be produced in transmission by suitably arranging small red, green and blue color regions, since any desired color can be represented as an additive color mixture of these three primary colors. For this purpose the subregions are formed for example in the form of small pixels or strips like in a conventional RGB display.

To be able to produce realistic true-color images, it has to be possible to adjust the brightness of the color regions in the individual pixels in targeted fashion. For this purpose, the color regions of individual pixels can be printed over in black or covered with an opaque metallization, wherein the technological challenge consists in the arrangement of the overprint or the coating in exact register.

Specifically, an optically variable area pattern for representing a true-color image can be manufactured with a black mask in exact register in the fashion described with reference to FIG. 8. FIG. 8 shows in (a) to (e) in cross-section various intermediate stages of the manufacture of the optically variable area pattern 110, wherein in each case only a small portion of the area pattern is shown, namely exactly one individual color pixel 112 with a red color region 114-R, a green color region 114-G and a blue color region 114-B. The size of the color pixel 112 is for example 100 μm×100 μm.

With reference to FIG. 8(*a*) in the red color region 114-R there are facets 32 with an inclination angle $\alpha=0°$ (corresponding to point 100 in FIG. 7), in the green color region 114-G there are facets 32 with an inclination angle $\alpha=25°$ (corresponding to point 102 in FIG. 7) and in the blue color region 114-B there are facets 32 with an inclination angle $\alpha=40°$ (corresponding to point 104 in FIG. 7) embossed in the lacquer layer 34. Between the facets 32 elevations 116 are provided, which later form the black area for each color area and the area ratio of which to the facets is chosen in accordance with the desired brightness of the respective color region. When, for example, the red component in the shown color pixel 112 is to have a brightness of 70%, the facets occupy 70% and the elevations occupy 30% of the total area of the color region 112-R.

Subsequently, the embossed lacquer layer 34, as shown in FIG. 8(*b*), is supplied all over with the chosen interference coating 36, such as the above-mentioned three-layer system of a first 25 nm thick silver layer, a nominally 330 nm thick $SiO_2$ spacer layer and a second 25 nm thick silver layer. At least the $SiO_2$ spacer layer is produced with directed coating methods, for example by vertical vapor deposition, so that the described dependence of the actual layer thickness of the spacer layer on the inclination angle $\alpha$ of the facet will be obtained.

Then, as shown in FIG. 8(*c*), the interference coating 36 is removed only on the elevations 116. This can be effected for example in a metal transfer method, as described in the document DE 10 2010 019 766 A1, or, for example, an etching resist can be printed overall on the coated lacquer layer and so doctored that the resist remains only in the faceted depressions and the interference coating 36 can be etched away from the elevations not covered with resist.

Now, a blackened photoresist 118 is applied to the opposite side of the area pattern, as shown in FIG. 8(*d*), and exposed from the upper side through the partially coated area pattern (reference numeral 120), as represented in FIG. 8(*e*). The exposure dose is chosen such that the photoresist exposed through the interference layer is removed during the development, but the photoresist exposed through the elevations 116 without interference layer remains. After the development in this fashion a black mask 122 is obtained on the back side of the area pattern, said black mask being blackened at precisely those locations where no facets 32 supplied with an interference layer 36 are present, as shown in FIG. 8(*f*). The area pattern of FIG. 8(*f*) is then further processed by further method steps to form the finished security element, for example by applying a further lacquer layer 38 to the interference coating 36 and by applying further protective or functional layers.

In another method variant, in the step of FIG. 8(*b*), it is possible to first apply an auxiliary layer, such as an opaque aluminum layer, instead of the interference coating, said auxiliary layer serving only for the structuring of the photoresist 118. After structuring the photoresist 118 for producing the black mask in the step of FIG. 8(*f*) the auxiliary layer is removed completely and the desired interference layer 36 is applied all over. This variant offers the advantage that the interference coating neither has to be capable of serving as a reliable exposure mask in the exposure step (FIG. 8(*e*)), nor does it have to be possible to etch away the interference coating easily (FIG. 8(*c*)). Rather, an auxiliary layer can be chosen that is optimized for these requirements, whereas the interference coating is chosen only due to the desired chromophore properties.

In principle, the black mask can also be produced by other methods, however, for example by metal transfer methods, etching methods or also directly or indirectly by laser ablation controlled by embossed structures.

LIST OF REFERENCE NUMERALS

10 banknote
12 see-through security element

14 through opening
16 foreground
18 background
20-R, 20-L tilt directions
30 planes of the area region
32 facets
34 embossing lacquer
36 interference coating
38 lacquer layer
40 incident light
42 plane normal
46, 48 interference layer normal
50, 52, 54 points in FIG. 3
60 security element
62, 64, 66 subregions
72, 74, 76 interference layer normal
50 security element
82, 84, 86, 88 subregions
90-O, 90-U tilt directions
92, 94, 96, 98 projected normal vectors
100, 102, 104 points in FIG. 7
110 optically variable area pattern
112 color pixels
114-R, 114-G, 114-B color regions
116 elevations
118 photoresist
120 exposure
122 black mask
Ref reference direction

The invention claimed is:

1. An optically variable see-through security element for securing value objects, with a flat, optically variable area pattern showing in transmission a colored appearance with a viewing-angle-dependent, polychrome color change, wherein the optically variable area pattern includes a multiplicity of facets which act in a substantially ray-optical manner, and the orientation of which is distinguished in each case by an inclination angle $\alpha$ relative to the plane of the area pattern which is between 0° and 45°, and by an azimuth angle $\theta$ in the plane of the area pattern, the facets are supplied with an interference layer with a viewing-angle-dependent color change in transmitted light, and the optically variable area pattern includes at least two subregions, respectively having a multiplicity of identically oriented facets, wherein the facets of the at least two subregions differ from each other with respect to the inclination angle relative to the plane and/or the azimuth angle in the plane;

wherein the optically variable area pattern includes at least three subregions which are arranged in the form of a background region and of two foreground regions and in which the inclination angles $\alpha$ and the azimuth angles $\theta$ of the facets and the interference layer are so mutually coordinated that the optically variable area pattern in transmission in a first tilted position shows a first motif in which the first foreground region appears with one motif color and the second foreground region and the background region appear with a background color different from the motif color, and in a second tilted position shows a second motif in which the second foreground region appears with the motif color and the first foreground region and the background region appear with the background color.

2. The see-through security element according to claim 1, wherein the area occupied by each subregion on the optically variable area pattern is at least 50 times greater than the area occupied on average by one individual facet of this area region.

3. The see-through security element according to claim 1, wherein the facets of the at least two subregions differ with respect to the inclination angle relative to the plane by 5° or more and/or that the facets of the at least two subregions differ with respect to the azimuth angle in the plane by 45° or more.

4. The see-through security element according to claim 1, wherein the facets are each provided with an interference layer the thickness of which varies with the inclination angle $\alpha$ of the facet, and decreases with an increasing inclination angle $\alpha$.

5. The see-through security element according claim 1, wherein the at least two subregions are arranged in the form of a motif, so that the optically variable area pattern in transmission shows the motif formed by the subregions with two or more different colors at least in certain tilted positions of the security element.

6. The see-through security element according to claim 1, wherein the inclination angles $\alpha$ and the azimuth angles $\theta$ of the facets and the interference layer are mutually coordinated in the subregions such that the subregions show the same colors in one certain tilted position and different colors in other tilted positions.

7. The see-through security element according to claim 1, wherein the optically variable area pattern includes at least four subregions which are arranged in the form of a background region, of two foreground regions and an overlap region, and in which the inclination angles $\alpha$ and the azimuth angles $\theta$ of the facets and the interference layer are so mutually coordinated that the optically variable area pattern in transmission in a first tilted position shows a first motif in which the first foreground region and the overlap region appear with a motif color and the second foreground region and the background region appear with a background color different from the motif color, and in a second tilted position shows a second motif in which the second foreground region and the overlap region appear with the motif color and the first foreground region and the background region appear with the background color.

8. The see-through security element according to claim 1, wherein the optically variable area pattern includes at least two subregions in which the facets have the same inclination angle $\alpha$, but azimuth angles $\theta$ which differ by 180°.

9. The see-through security element according to claim 1, wherein the optically variable area pattern includes a first and second subregion in which the facets have the same inclination angle $\alpha_0$, but azimuth angles $\theta$ which differ by 180°, and a third and fourth subregion in which the facets have different inclination angles $\alpha_1$ and $\alpha_2$ and in which the azimuth angle $\theta$ differs from the azimuth angle of the first and second subregion by 90° or 270°.

10. The see-through security element according to claim 1, wherein the optically variable area pattern includes at least three subregions in which the inclination angles $\alpha$, and the azimuth angles $\theta$ of the facets and the interference layer are so mutually coordinated that the subregions in a tilted position in transmission appear in red, green or blue.

11. The see-through security element according to claim 10, wherein the optically variable area pattern in the subregions additionally has a black mask placed in register with the inclined facets, said black mask serving to adjust the transmission brightness of the facets in the respective subregions.

12. The see-through security element according to claim 10, wherein the three subregions, together with or without a black mask placed in register, respectively represent the color separations of a true-color image.

13. The see-through security element according to claim 1, wherein the facets are embossed into an embossing lacquer layer with a first refractive index, and over the interference layer there is applied a lacquer layer with a second refractive index which differs from the first refractive index by less than 0.3.

14. The see-through security element according to claim 1, wherein the interference layer is formed by a thin film element with semitransparent metal layers and a dielectric spacer layer, by a dielectric layer structure with at least one highly refractive layer, combined with at least one lowly refractive layer, or includes at least one cholesteric liquid crystal layer.

15. The see-through security element according to claim 1, wherein the facets are formed substantially as flat area elements.

16. The see-through security element according to claim 1, wherein the facets are arranged in a periodical grid and in particular form a sawtooth grating, or that the facets are arranged aperiodically.

17. The see-through security element according to claim 1, wherein the facets have a smallest dimension of more than 2 μm, and/or that the facets have a height below 100 μm.

18. A data carrier with a see-through security element according to claim 1, wherein the see-through security element is arranged in or above a window region or a through opening of the data carrier.

19. An optically variable see-through security element for securing value objects, with a flat, optically variable area pattern showing in transmission a colored appearance with a viewing-angle-dependent, polychrome color change, wherein the optically variable area pattern includes a multiplicity of facets which act in a substantially ray-optical manner, and the orientation of which is distinguished in each case by an inclination angle $\alpha$ relative to the plane of the area pattern which is between 0° and 45°, and by an azimuth angle $\theta$ in the plane of the area pattern, the facets are supplied with an interference layer with a viewing-angle-dependent color change in transmitted light, and the optically variable area pattern includes at least two subregions, respectively having a multiplicity of identically oriented facets, wherein the facets of the at least two subregions differ from each other with respect to the inclination angle relative to the plane and/or the azimuth angle in the plane;

wherein the optically variable area pattern includes at least four subregions which are arranged in the form of a background region, of two foreground regions and an overlap region, and in which the inclination angles $\alpha$ and the azimuth angles $\theta$ of the facets and the interference layer are so mutually coordinated that the optically variable area pattern in transmission in a first tilted position shows a first motif in which the first foreground region and the overlap region appear with a motif color and the second foreground region and the background region appear with a background color different from the motif color, and in a second tilted position shows a second motif in which the second foreground region and the overlap region appear with the motif color and the first foreground region and the background region appear with the background color.

20. An optically variable see-through security element for securing value objects, with a flat, optically variable area pattern showing in transmission a colored appearance with a viewing-angle-dependent, polychrome color change, wherein the optically variable area pattern includes a multiplicity of facets which act in a substantially ray-optical manner, and the orientation of which is distinguished in each case by an inclination angle $\alpha$ relative to the plane of the area pattern which is between 0° and 45°, and by an azimuth angle $\theta$ in the plane of the area pattern, the facets are supplied with an interference layer with a viewing-angle-dependent color change in transmitted light, and the optically variable area pattern includes at least two subregions, respectively having a multiplicity of identically oriented facets, wherein the facets of the at least two subregions differ from each other with respect to the inclination angle relative to the plane and/or the azimuth angle in the plane;

wherein the optically variable area pattern includes a first and second subregion in which the facets have the same inclination angle $\alpha_0$, but azimuth angles $\theta$ which differ by 180°, and a third and fourth subregion in which the facets have different inclination angles $\alpha_1$ and $\alpha_2$ and in which the azimuth angle $\theta$ differs from the azimuth angle of the first and second subregion by 90° or 270°.

* * * * *